United States Patent [19]

Watts

[11] 3,938,598

[45] Feb. 17, 1976

[54] BELLING APPARATUS

[76] Inventor: James P. Watts, 6930 E. Pinchot Ave., Scottsdale, Ariz. 85251

[22] Filed: May 14, 1975

[21] Appl. No.: 577,300

[52] U.S. Cl. ..... 175/99; 175/102; 175/267; 175/310

[51] Int. Cl.[2] ..... E21B 3/08; E02D 17/14

[58] Field of Search ..... 175/95, 98, 99, 102, 230, 175/267, 263, 284, 310, 292

[56] References Cited

UNITED STATES PATENTS

| | | | |
|---|---|---|---|
| 902,517 | 10/1908 | Wittich | 175/230 |
| 2,000,195 | 5/1935 | Siebel | 175/313 |
| 2,091,779 | 8/1937 | Gooder | 175/98 |
| 2,250,670 | 7/1941 | Joy | 175/310 |
| 2,769,614 | 11/1956 | Zeni | 175/102 |
| 2,798,707 | 7/1957 | Kandle | 175/102 |

*Primary Examiner*—James A. Leppink
*Attorney, Agent, or Firm*—John A. Robertson

[57] ABSTRACT

The present invention relates to belling apparatus for forming a bell shaped recess at the lower end of a pier bore and is concerned primarily with such apparatus in which spoil generated by cutting the recess is continuously removed by an auger.

12 Claims, 9 Drawing Figures

BELLING APPARATUS

BACKGROUND OF THE INVENTION

At the present time it is the common, if not universal, practice to provide the lower ends of concrete piers which constitute the foundation for a building with conical formations which resemble a bell and are commonly so called by those working in this art. A pier with a bell thereon is formed at the same time by pouring concrete into a cylindrical pier bore having a bell shaped recess at its lower end.

Ordinarily the cylindrical pier bore is first formed by an auger and extends from the ground surface to the rock bed or other earth formation which is to support the pier. The bell shaped recess is formed usually by rotating one or more blades that are pivotally mounted at their upper ends and gradually swung outwardly by eccentric links. These cutting operations create spoil which must be removed.

One school of removing the spoil is to use a liquid such as water or drilling mud and operations of this type are confined to offshore drilling for oil wells. They clearly are not susceptible for use for the formation of piers as a support for buildings in locations removed from the coast and structures not related to oil wells.

Another method of operation is to remove the bell cutting apparatus after a portion of the bell shaped recess is formed and then removing the spoil so far formed. The removal of the spoil often requires the entry of a man into the lower end of the bore. Even should manual operations not be required for the spoil removal, safety regulations now obtaining in most jurisdictions require that the bell recess be inspected at several stages of its formation. Thus in some jobs it has been necessary to withdraw the belling apparatus and remove the spoil as many as fifty times in the formation of a single bell recess. These repeated entries of a man into the excavation constitute an impairment of the safety factor to a high degree.

Another undesirable phase attending the cutting of bell shaped recesses in accordance with present use of cutting blades of the type noted, is the danger of overcutting. Bells are designed for a certain angle of the conical end portion. Should the cutting blades be swung out to an angle in excess of that of a particular bell, the recess will not have the required shape and great difficulty is experienced in correcting such an error.

The known art is notably lacking in apparatus which is effective to cut a bell shaped recess at the lower end of a pier bore on what might be called a single downward pass of the apparatus and at the same time remove the spoil.

OBJECTS OF THE INVENTION

With the foregoing conditions in mind the present invention has in view the following objectives:

1. To provide belling apparatus which will cut a bell shaped recess at the lower end of a pier bore and remove spoil from the cutting operation on a single downward pass of the apparatus.

2. To provide, in belling apparatus of the type noted, a fixed cylindrical auger casing which is centrally spaced from the walls defining the pier bore together with an auger in the casing and means for rotating the auger.

3. To provide, in belling apparatus of the character aforesaid, a two-part cylindrical housing which lines the pier bore and which comprises a fixed upper housing and a lower rotating housing connected to the lower end of the upper housing.

4. To provide, in belling apparatus of the kind described, driving means mounted on the fixed upper housing for rotating the lower housing.

5. To provide, in belling apparatus of the type noted, mechanism for holding the fixed upper housing against rotation relative to the pier bore.

6. To provide, in belling apparatus of the character aforesaid, a collar which is rotatable and axially moveable on the auger casing and to which the upper ends of a pair of cutting blades are pivotally mounted.

7. To provide, in belling apparatus of the kind described, a lower rotating housing formed with a pair of diametrically opposed slots through which the lower portions of the blades may be swung.

8. To provide, in belling apparatus of the character aforesaid, an eccentric link for each of said blades, each of said links having its upper end pivotally connected to a blade between its ends and its lower end pivoted to the rotating housing whereby downward movement of the collar causes the eccentric links to swing the blades outwardly through the slots.

9. To provide, in belling apparatus of the character aforesaid, an adjustable stop on the auger casing for limiting downward movement of the collar to prevent overcutting of the recess.

10. To provide, in belling apparatus of the kind mentioned above, a pair of diametrically opposed feed ports at the lower end of the auger casing together with a spoil feeding device at each of said ports.

11. To provide, in belling apparatus of the type noted, a disc that is pivotally mounted to the lower rotating housing at the lower end thereof and which is formed with a scraper that is struck therefrom to pick up loose material from the bottom of the pier bore as the lower housing is rotated.

12. To provide, in belling apparatus of the character aforesaid, a wave shaped plate that is mounted on the auger casing below the feed ports therein and which has a pair of feeding tabs depending therefrom.

13. To provide, in belling apparatus of the kind described, an auger casing which extends above the ground surface with the extended portion having a discharge port and a conveyor having one end at the discharge port which receives spoil from the auger.

14. To provide, in belling apparatus as described above, hydraulic motors for actuating the various elements, together with a control panel including valves for controlling operation of the hydraulic motors.

Various other more detailed objects and advantages of the invention, such as arise in connection with carrying out the above noted ideas in a practical embodiment will in part become apparent and in part be hereinafter stated as the description of the invention proceeds.

SUMMARY OF THE INVENTION

The foregoing objects are achieved by providing belling apparatus comprising a cylindrical auger casing that extends from substantially the bottom of a pier bore to a level above the ground surface and which is coaxial with and spaced from the pier bore. Rotatable in this casing is an auger and a hydraulic motor is provided for rotating the auger.

An upper cylindrical housing is snugly received in the upper portion of the pier bore and is held against rotation by anchoring devices which may be either of two types. In one type pointed earth penetrating members are actuated to enter the earth at the bore surface. The other type is magnetic and is used when the upper portion of the pier bore is lined with a ferrous sleeve.

Rotatably connected to the lower end of this fixed upper housing is the lower rotating housing which extends to the bottom of the bore. Hydraulic motors mounted on the upper housing have drive shafts formed with pinions which mesh with an internally toothed ring gear on the lower housing.

The lower housing is formed with a pair of diametrically opposed slots. Rotatable and axially slideable on the auger casing above these slots is a collar to which the upper ends of a pair of cutting blades are pivoted in position so that lower portions of the blades may be swung through the slots in the housing. An eccentric link is associated with each blade to cause this swinging movement as an incident to axial movement of the collar on the auger casing. The upper end of each link is pivoted to a blade between the ends thereof and the lower end to the rotating housing.

An adjustable stop is mounted on the auger casing below the collar to limit downward movement of the collar. This stop is positioned to accommodate a bell recess having a particular angle of taper so that this angle cannot be exceeded by the cutting blades, hence over-cutting is definitely precluded.

The lower end of the auger casing is formed with a pair of diametrically opposed feed ports and a spoil feeding device is associated with each port. Each of these devices may take the form of a roller having projecting fingers and which is driven by a hydraulic motor.

A disc is pivotally mounted to the lower end of the rotating housing whereby it is moveable into and out of position closing the lower end of the housing. This disc has a scraper struck therefrom whereby an opening is left therein so that upon rotation of the housing loose materials which may have collected at the bottom of the pier bore are picked up by the scraper and passed to the upper side of the disc.

Secured to the auger housing immediately below the feed ports is a wave shaped ring having a pair of tabs depending therefrom which are struck from the ring to leave an opening at each tab. As the lower housing rotates the disc at the lower end thereof rotates and material on the upper face thereof is picked up by these tabs and passed to the feeding device.

That portion of the auger casing which projects above the ground surface is formed with a discharge port. One end of a conveyor is mounted on the auger casing immediately below the discharge port to receive spoil from the auger.

The ring gear on the lower housing casing is driven by hydraulic motors. The feeders are also driven by hydraulic motors and the collar to which the cutting blades are secured is moved axially by hydraulic cylinders. The devices which hold the upper casing against rotation are hydraulically actuated. The auger is also driven by a hydraulic motor and as the conveyor takes the form of an endless belt it is also driven by a hydraulic motor. Thus the belling apparatus also includes a control panei on which is mounted a control valve for each of these hydraulic devices. Also mounted on this panel is a tachometer which indicates operation of a ring gear motor. A gauge is also displayed on the panel and is effective to indicate pressure on the working side of the valve for the hydraulic cylinders which actuate the collar.

For a full and more complete understanding of the invention reference may be had to the following description and accompanying drawings wherein:

FIG. 1 is a vertical section through a pier bore with the belling apparatus of this invention therein. Parts of the apparatus are shown in section and other parts in elevation.

FIG. 1*a* is a detail, partly in section and partly in elevation, of the modification of anchoring devices for the upper housing.

DESCRIPTION OF A PREFERRED EMBODIMENT

Figures 1, 1A, 8:
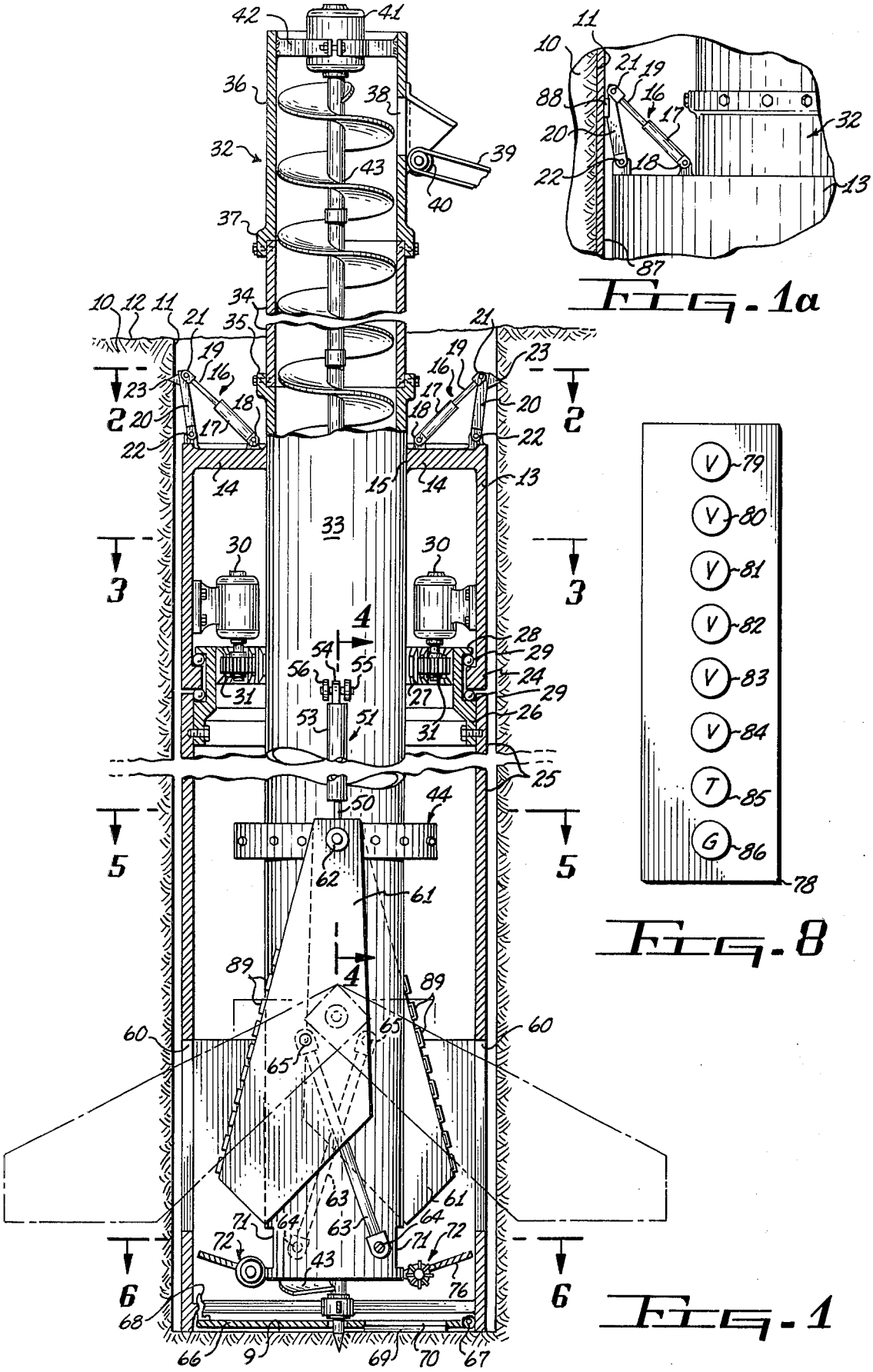
FIG. 8 is a diagrammatic illustration of the control panel.
Figure 2:
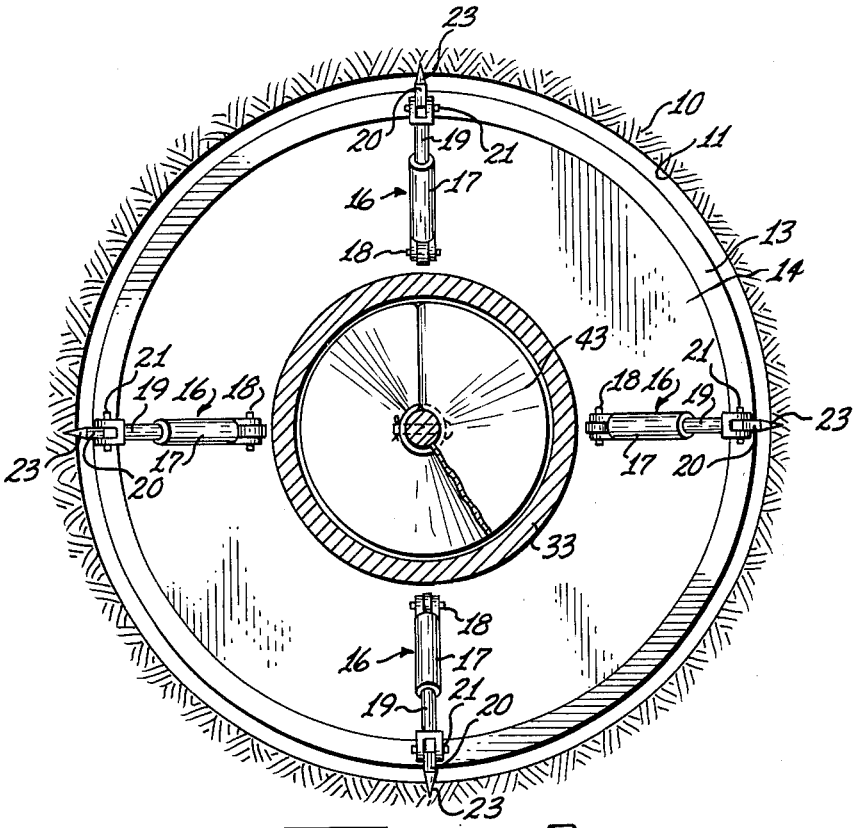
FIG. 2 is a top plan view of the appratus being taken on the plane of the line 2—2 of FIG. 1.
Figure 3:
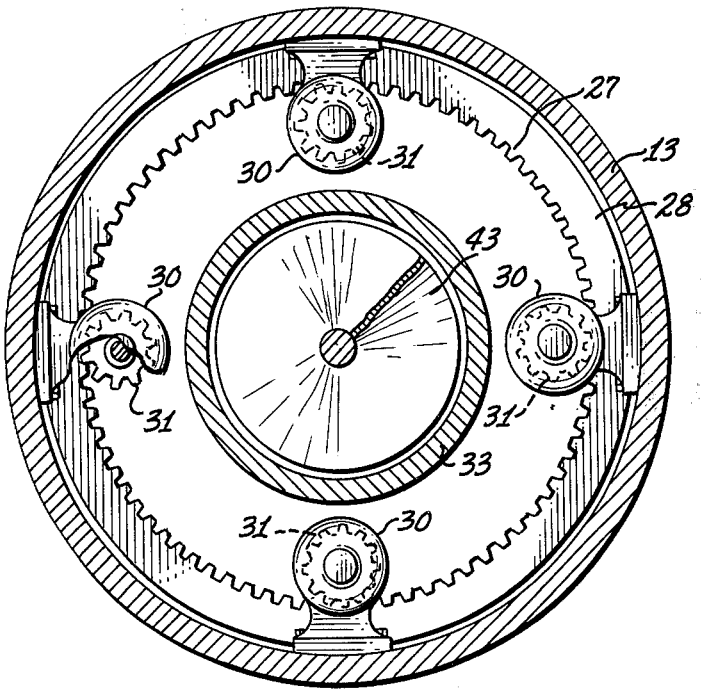
FIG. 3 is a horizontal section taken on the plane of the line 3—3 of FIG. 1.

Referring now to the drawings wherein like reference characters denote corresponding parts throughout the several views, and first more particularly to FIG. 1, a ground formation 10 is shown as formed with a cylindrical pier bore 11 which extends from ground surface 12 to bottom 9. Mounted in the upper portion of pier bore 11 is a fixed cylindrical housing 13. The upper end of housing 13 is closed by a ring like plate 14 which defines a central opening 15. Mounted on the upper face of the plate 14 are four anchoring devices each of which is identified in its entirety by the reference character 16. These anchoring devices 16 are equiangularly spaced apart as illustrated in FIG. 2.

Each anchoring device 16 comprises a hydraulic cylinder 17 the lower end of which is pivotally mounted at 18 on plate 14 and from the upper end of which projects a piston 19. The upper end of piston 19 is pivotally connected to an arm 20 as indicated at 21 with the lower end of arm 20 being pivotally mounted at 22 on ring 14. The upper end of arm 20 carries a penetrating member 23 which enters the earth formation 10 when piston 19 is extended under the influence of hydraulic cylinder 17.

The lower end of upper housing 13 is formed with an inturned flange 24. A lower cylindrical housing 25 presents an open upper end to which is anchored a flange 26 depending from an internal ring gear 27. An upper flange 28 on gear 27 is spaced from flange 24 to provide a bearing race which receives ball bearings 29. The lower face of flange 24 and upper face of flange 26 define another bearing race which also receives ball bearings 29.

Mounted on the inner surface of upper housing 13 and projecting inwardly therefrom are a pair of hydraulic motors 30. Each of these motors 30 has a drive shaft on which is mounted a pinion 31 which meshes with ring gear 27. It is evident that motors 30 may be energized to rotate lower housing 25.

An auger casing is designated generally 32. It comprises a main body portion 33 which passes through opening 15 in ring 14 and to which it is fixedly secured as by welding. Main body portion 33 extends from a level above ring 14 to a level slightly spaced above bottom 9 of pier bore 11.

Considered in its entirety auger casing 32 should extend above ground surface 12 but the degree of such extension will depend on the conditions of a particular job. Thus to render the projecting portion extensible an intermediate section 24 is provided with its lower end being secured to the upper end of body section 33 as indicated at 35 and its upper end to a top section 36 as indicated at 37. Top section 36 is formed with a discharge port 38 and endless conveyor 39 has one end anchored to casing section 36 below port 38 and may be driven by hydraulic motor represented diagrammically at 40.

Another hydraulic motor 41 is mounted on the other end of casing section 36 in a preferred manner such as by a frame 42. The drive shaft of motor 41 is driveably connected to an auger 43. Auger 43 is a conventional type with the screw flights thereof being snugly received in auger casing 32. Auger 43 extends the full length of auger casing 32.

Figure 4:
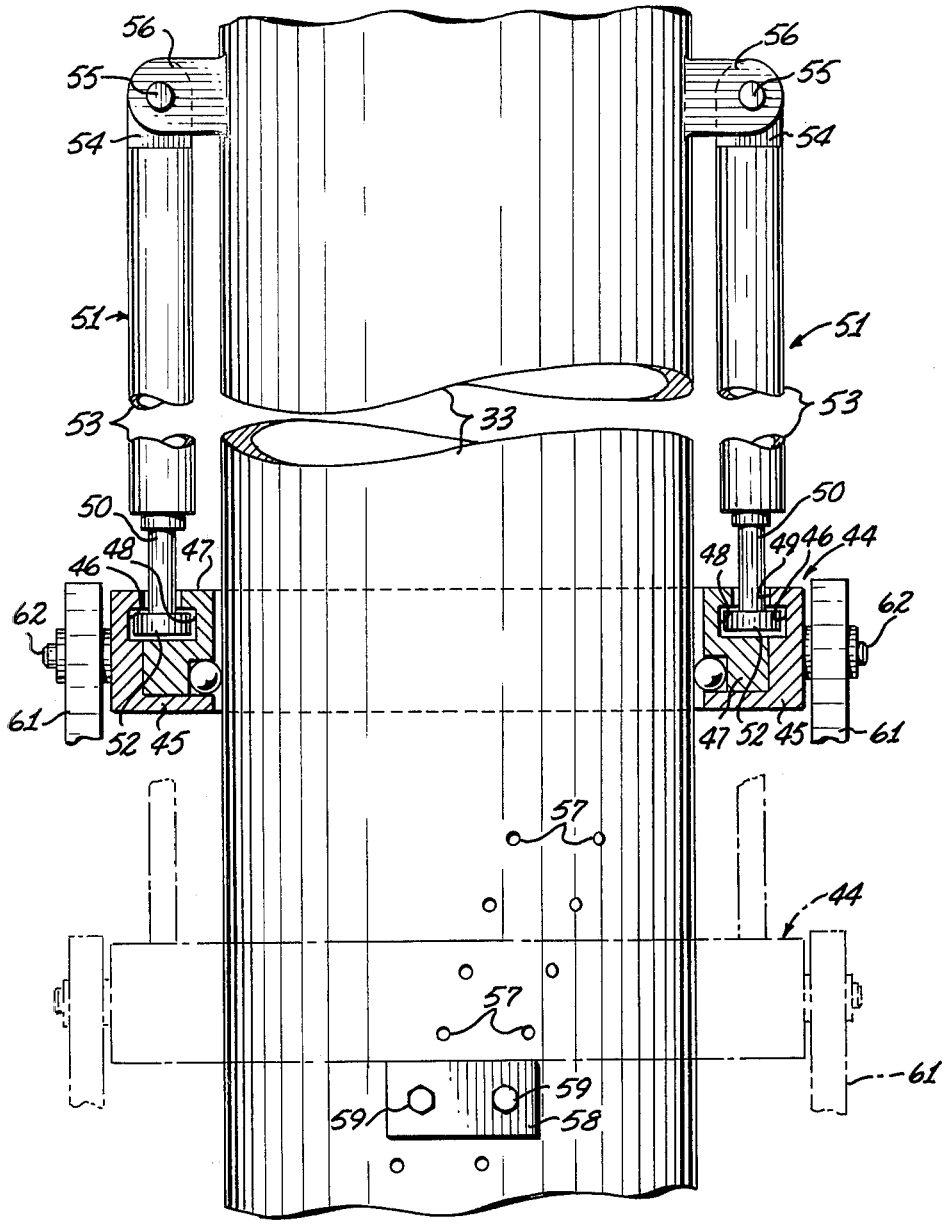
FIG. 4 is an elevation taken on an enlarged scale of the apparatus where the upper and lower housings are connected and illustrates particularly the adjustable stop for the collar.

Referring now more particularly to FIG. 4, a collar is designated generally 44. It is rotatable about casing section 33 and is also axially moveable thereon. Collar 44 comprises an outer L shaped member 45 formed with an inwardly opening annular groove 46. Mating with outer member 45 is an inner member 47 formed with an outwardly opening annular groove 48. Thus the grooves 46 and 48 confront one another, but the upper portions of the members 45 and 47 are spaced with respect to one another to form an annular slot 49. A piston rod 50 of a hydraulic cylinder and piston assembly designated generally 51 passes through slot 49 and has a head 52 received in the grooves 46 and 48. There is a second hydraulic cylinder and piston assembly 51 which is mounted on casing section 33 and in diametrically opposed relation to the one so far described. Each of these assemblies includes a cylinder 53 the upper end of which carries an ear 54 that is pivotally connected at 55 to a tab 56 which projects from casing section 33. It is evident that cylinders 53 may be energized to extend pistons 50 and thus move collar 44 downwardly or conversely the hydraulic medium may be exhausted from cylinders 53 to move collar 44 upwardly. It is important to note that the connection of pistons 40 to collar 44 provide for rotation of the latter about casing section 33.

It will be noted from FIG. 4 that casing section 33 is formed with two series of threaded sockets 57 with one socket of one series in horizontal alignment with the socket of the other series. This provides for mounting an abutment element 58 on casing section 13 in position for limiting downward movement of collar 44. Headed screws 59 pass through openings in blocks 58 and are screwed into sockets 57 to hold abutment 58 in position.

Figure 5:
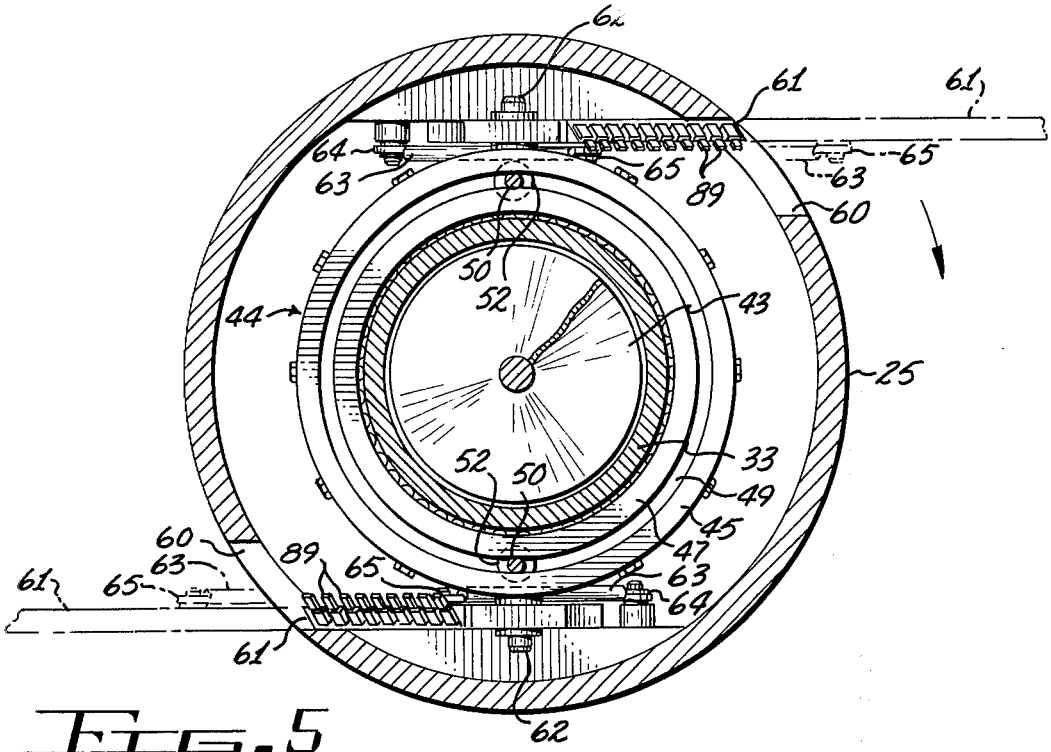
FIG. 5 is a horizontal section taken on the plane of the line 5—5 of FIG. 1.
Figure 6:
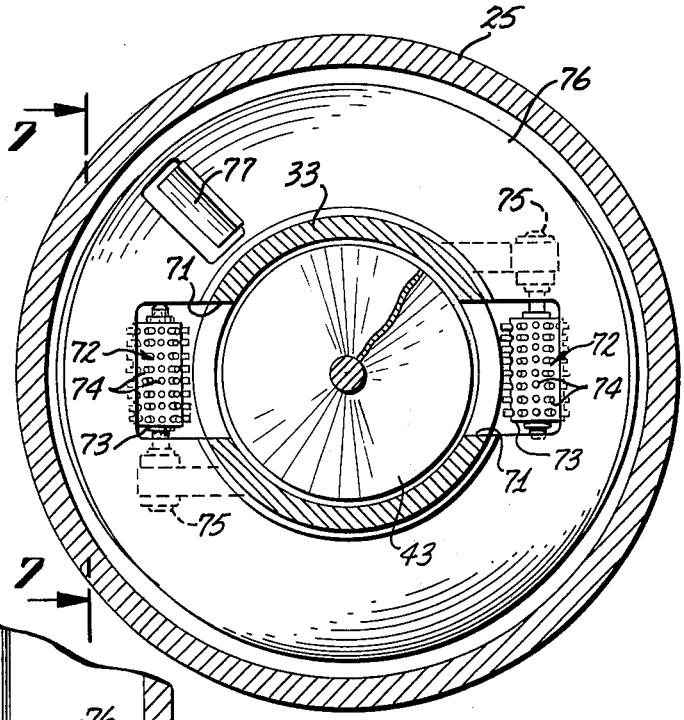
FIG. 6 is another horizontal section taken on the apparatus of the line 6—6 of FIG. 1.

Referring now more particularly to FIGS. 1 and 5, lower rotating housing 25 is shown as formed with a pair of wide slots 60 adjacent to its lower end. A pair of cutting blades 61 are pivotally mounted at their upper ends to collar 44 in positions which permit lower end portions of the blades to swing outwardly through slots 60. The pivotal mounting of each of these blades is shown as 62 in FIG. 4. An eccentric link 63 is associated with each blade 61 to cause it to swing either inwardly or outwardly upon axial movement of collar 44 depending on the direction of movement of the latter. More particularly eccentric link 63 swings the lower portion of blades 61 outwardly through slot 60 on downward movement of collar 44. Each link 63 has its lower end secured to rotating housing 25 as indicated at 64 and its upper end is pivotally connected to blade 61 as indicated at 65. The latter point is located between the ends of blade 61 somewhat below the midway point of each blade. These particular points of connection may vary with different engineering designs.

It is evident that with lower portions of blade 61 projecting through slot 60 and housing 25 rotating, earth is cut from the formation 10 and will pass through the slots 60 into the interior of housing 25.

Referring now to the lower portion of FIG. 1, a disc 66 is pivotally mounted at 67 to the lower end of housing 25 and is secured in position closing the housing bottom by spring fastener shown at 68. This pivotal mounting is provided to permit opening of the lower end of housing 25 after the belling apparatus is removed from the pier bore.

A scraper 69 is struck from disc 66 and its formation leaves an opening 70. Often loose materials will collect at the bottom of a pier bore and upon rotation of housing 25 in a clockwise direction scraper 69 will pick up such materials and pass them through opening 70 onto the upper face of disc 66.

Figure 7:
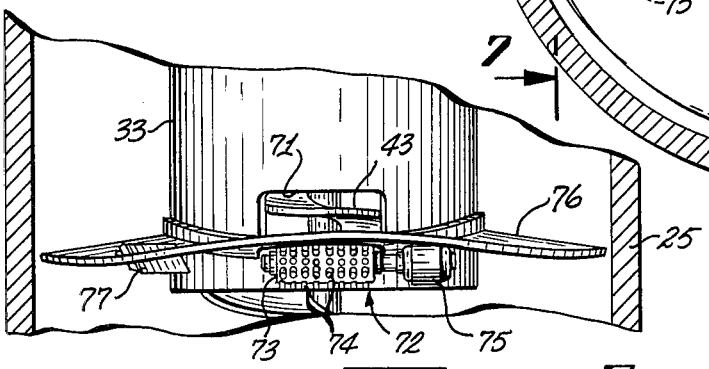
FIG. 7 is a detail on an enlarged scale and illustrating the lower end of the auger casing, the feed devices thereon and the wave shaped ring.

Referring now to the lower end of FIG. 1 and FIG. 7, casing section 33 is shown as formed with a pair of diametrically opposed feed ports 71. Mounted on casing section 33 below each feed port 71 is a spoil feeding device designated generally 72. Each of these feeders 72 comprises a roll 73 from which project a plurality of fingers 74. Each roll 73 is rotated by a hydraulic motor 75. Mounted on casing section 33 on substantially the same plane as the lower edges of feed port 71 is a wave shaped plate 76 which has a pair of tabs 77 struck and depending therefrom. As housing 25 is rotated disc 66 is also rotated and materials thereon are picked up by tabs 77 and passed to feeding devices 72.

FIG. 8 illustrates diagrammatically a control panel on which is mounted control valves for the various hydraulic devices as well as a tachometer and a pressure gauge. The panel is designated as 78. The valve represented as 79 controls the motor for ring gear 27. Valve 80 controls feeder motors 75. Valve 81 is for the hydraulic cylinders 53. Valve 82 controls hydraulic cylinder 17 of anchoring devices 16. Valve 83 is for auger motor 41 and valve 84 is for hydraulic motor 40 which operates conveyor 29. The tachometer represented by 85 is operably connected with one of the motors 30 to indicate the rotative condition of ring gear 27 and particularly to advise of a stoppage in such rotation. The gauge shown at 86 is connected to the working side of valve 81 to indicate the pressure condition in cylinders 53 such as when collar 44 engages with abutment 58.

MODIFICATION

FIG. 1*a* illustrates a modification in which the upper portion of pier bore 11 is lined with a sleeve 87 of a ferrous material such as steel. The holding device represented generally as 16 is different from that illustrated in FIGS. 1 and 2 in that penetrating element 23 is replaced by a magnet 88 which preferably would be an electro magnet.

Just as illustrated in FIG. 2 there will be a plurality of the holding devices 16 in FIG. 1*a*.

OPERATION

While the manner in which the subject belling apparatus operates is believed to be obvious from the illustrations of the drawings and descriptions of parts set forth above, it is briefly described as follows:

Abutment 58 is first positioned to determine the angle of the bell shaped recess which is to be cut. The apparatus in its entirety is then lowered into pier bore 11. After it is so lowered upper housing 13 is anchored against rotation by operating valve 82 to energize cylinders 17 of anchoring devices 16. Ordinarily collar 44 will be in a position upraised sufficiently for blades 61 to be positioned completely within lower housing 25. Valve 79 is operated to start motors 30 in operation to rotate ring gear 27. This causes rotation of lower housing 25. At the same time valve 83 is operated to start operation of motor 41 to rotate auger 43. Valve 81 is then operated to apply hydraulic pressure to cylinders 53 which cause the pistons 50 to extend and force the collar downwardly. As this action takes place, eccentric links 63 swing blades 61 outwardly through the slots 60.

Upon referring to FIG. 5 it will be noted that blades 61 are formed with teeth 89 on their cutting edges which are determined by the direction of rotation. It is customary in this art to rotate augers and similar tools in a clock-wise direction when excavating work is to be performed. Moreover, it is noteable that blades 61 are so mounted as to receive substantial support from the vertical side edges of slots 60.

As housing 25 rotates with the blades 60 being gradually extended, spoil from the cutting of the earth formation will pass through slots 60 into the interior of housing 25. This spoil will fall on to plate 76 and be fed through ports 71 to auger 43 by feeding devices 72. The auger moves the spoil upwardly to upper casing section 36 whence it is discharged through port 38 onto conveyor 39.

When collar 44 engages abutment 58 no further extension of blades 61 is permitted and the bell recesses should have been cut to its pre-determined size and shape.

It is notable that if any unforeseen obstacles should be encountered during the operation, such as unexpected resistance to the cutting blades, housing 25 will cease to rotate and this condition will be indicated by the tachometer 85. Moreover, the pressure indicated by gauge 86 will advise the operator of the apparatus that collar 44 has engaged abutment 58.

While preferred specific embodiments of the invention have been illustrated and described, it is to be clearly understood that the invention is not to be limited to the exact constructions, mechanisms and devices illustrated and described because various modifications of these details may be provided in putting the invention into practice.

What is claimed is:

1. In apparatus for cutting a bell shaped recess in an earth formation in the lower end of a cylindrical pier bore which enters said formation from the ground surface;

a. an upper fixed cylindrical housing in the upper portion of said pier bore, b. anchoring devices on said housing for holding the housing against rotation relative to the pier bore, c. a lower rotating housing connected to the lower end of said upper housing and extending substantially to the bottom of said pier bore, said lower housing being formed with a slot adjacent to its lower end, d. drive means for rotating said lower housing under power, e. an auger casing coaxial with said housing, spaced therefrom and extending from a point above the ground surface to a level a small distance above the bottom of the pier bore, f. a discharge port in said auger casing above said ground surface;

g. an auger in said auger casing h. power means for rotating said auger, i. a collar rotatably and axially moveable on said auger casing, j. power means for moving said collar axially on said auger casing, k. a blade having its upper end pivoted to said collar in a position in which the lower portion of the blade may be swung through the slot in the rotating housing, l. an eccentric link having an upper end pivoted to said blade between the ends thereof and a lower end pivoted to said rotating housing whereby downward movement of said collar causes the lower portion of said blade to be swung outwardly through said slot;

m. a feed port in the lower end of said auger casing and a feeding device on said auger casing at said feed port for feeding spoil from said slot through the feed port to the auger.

2. The belling apparatus of claim 1 together with an adjustable abutment on said auger casing to limit downward movement of said collar.

3. The belling apparatus of claim 1 together with a disc pivotally mounted to the lower end of said rotating housing and formed with a depending scraper which passes loose material in the bottom of said pier bore through an opening in said disc to the upper surface of said disc upon rotation of said rotating housing.

4. The belling apparatus of claim 3 together with a catch for holding said disc in position closing the end of said rotating housing.

5. The belling apparatus of claim 3 together with a wave shaped plate mounted on said auger casing immediately below the feed port therein and formed with a depending tab to pick up material on said disc.

6. The belling apparatus of claim 1 in which there are two of said slots in the rotating housing and two of said feed ports and feeding devices associated therewith.

7. The belling apparatus of claim 1 in which the drive means for rotating said rotating housing comprises an internal ring gear on the lower rotating housing and at least one hydraulic motor having a pinion meshing with the ring gear.

8. The belling apparatus of claim 1 in which the power means for moving said collar axially on said auger casing comprises at least one hydraulic cylinder and piston assembly.

9. The belling apparatus of claim 1 in which there is a second slot in said rotating housing diametrically opposed to said first slot together with a second blade having its upper end pivoted to said collar in a position in which the lower portion of said second blade swings through said second slot upon axial movement of said collar.

10. The belling apparatus of claim 1 in which the upper end of said upper end fixed housing is closed by a ring like plate and each of said anchoring devices comprises a hydraulic cylinder having its lower end pivoted to said plate, a piston protruding from the upper end of said cylinder, an arm having its lower end pivoted to said plate and its upper end pivoted to the free end of said piston and an earth penetrating member on the upper end of said arm.

11. The belling apparatus of claim 1 in which the upper portion of the pier bore is lined with a ferrous sleeve and the upper end of said fixed upper housing is closed by a ring like plate, with each of said anchoring devices comprising a magnet and means on said ring like plate for moving said magnet into engagement with said ferrous sleeve.

12. The belling apparatus of claim 1 in which the blade has teeth on its cutting edge.

* * * * *